United States Patent [19]

Engelberts

[11] 4,163,473

[45] Aug. 7, 1979

[54] HEAT EXCHANGER

[75] Inventor: Gerhardus A. Engelberts, Breda, Netherlands

[73] Assignee: B.V. Machinefabriek "Breda" voorheen Backer en Rueb, Breda, Netherlands

[21] Appl. No.: 830,311

[22] Filed: Sep. 2, 1977

Related U.S. Application Data

[63] Continuation of Ser. No. 640,765, Dec. 15, 1975.

[30] Foreign Application Priority Data

Dec. 24, 1974 [NL] Netherlands ..... 7416886
Dec. 24, 1974 [NL] Netherlands ..... 7416887

[51] Int. Cl.[2] ..... F28F 9/02
[52] U.S. Cl. ..... 165/157
[58] Field of Search ..... 165/82, 83, 81, 130, 165/131, 141, 2, 5, 157, 158, 68; 122/32, 34

[56] References Cited

U.S. PATENT DOCUMENTS

| | | | |
|---|---|---|---|
| 1,798,330 | 3/1931 | Leek | 165/141 |
| 2,475,025 | 7/1949 | Huff | 165/142 X |
| 3,443,548 | 5/1969 | Rich et al. | 165/157 X |
| 3,666,423 | 5/1972 | Muenger | 165/157 |
| 3,942,589 | 3/1976 | Opitzer | 165/157 |
| 3,968,834 | 7/1976 | Mangus et al. | 165/68 |

FOREIGN PATENT DOCUMENTS

| | | | |
|---|---|---|---|
| 649518 | 12/1962 | Italy | 122/32 |
| 647645 | 12/1950 | United Kingdom | 165/157 |

*Primary Examiner*—Samuel Scott
*Assistant Examiner*—Theophil W. Streule, Jr.
*Attorney, Agent, or Firm*—William P. Keegan

[57] ABSTRACT

Heat exchanger comprising at least one tube handle, communicating on the one hand with a distribution header and on the other hand with a collection header, in which at least one distribution stage consisting of a plurality of manifolds and/or a collecting stage is arranged between the tube handle and the distribution header or the collection header respectively so that one medium is stepwise divided uniformly in partial streams and/or these partial streams are uniformly united to a main stream.

11 Claims, 11 Drawing Figures

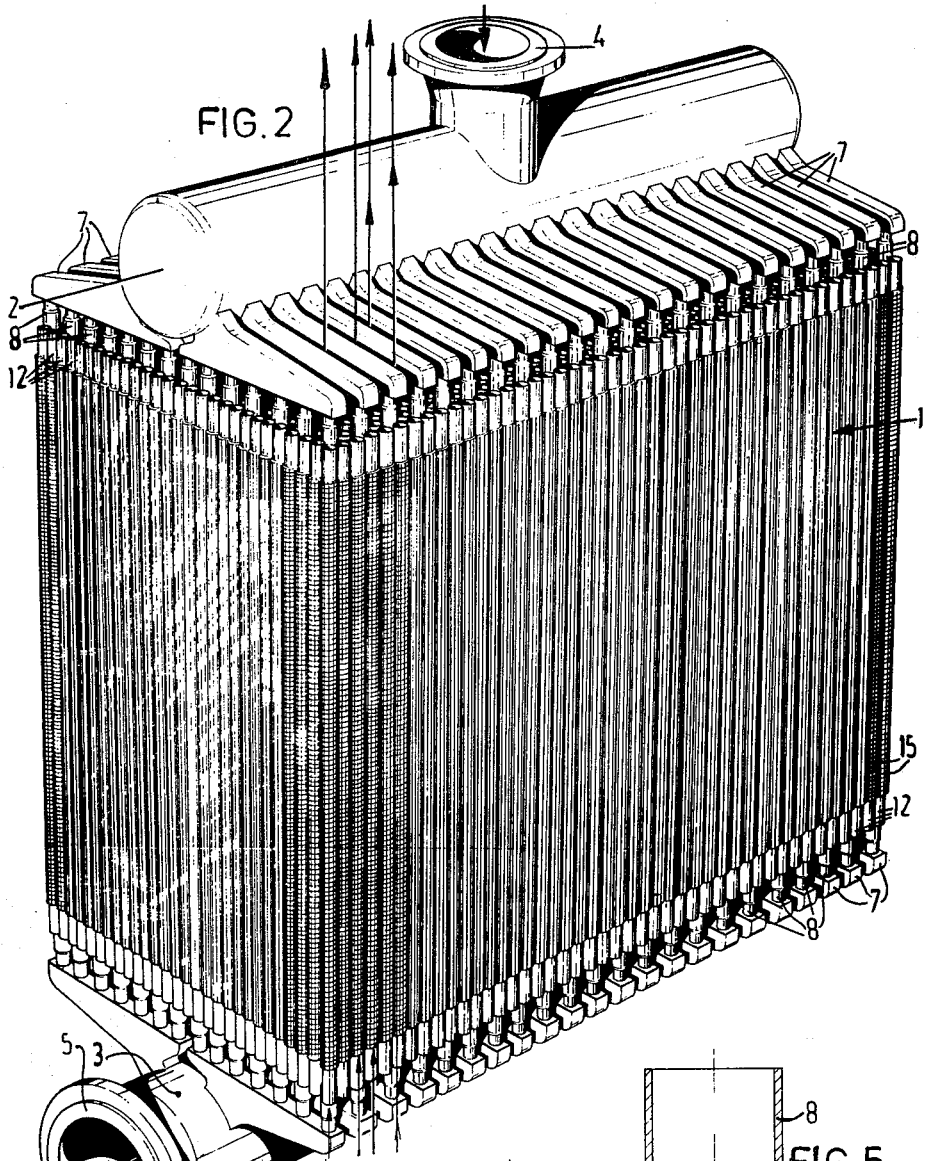
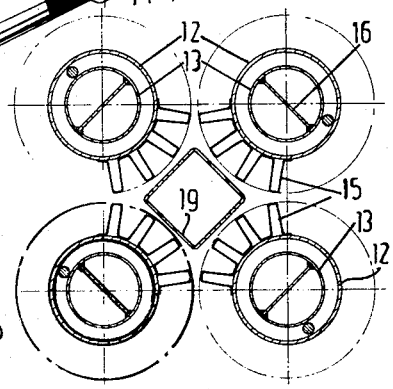
FIG.6
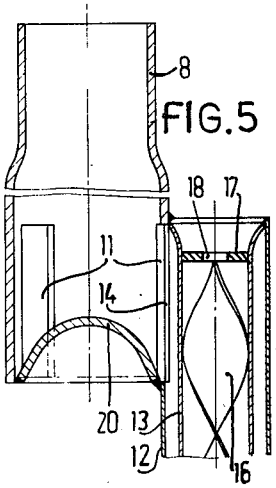
FIG.5

HEAT EXCHANGERThis is a continuation of application Ser. No. 640,765, filed Dec. 15, 1975.

The invention relates to a heat exchanger comprising at least one tube handle, through which a medium flows in parallel streams, which communicate on the one hand with a distribution header and on the other hand with a collection header while an envelope around the tube bundle guides a different medium around the tubes.

The invention further relates to a method of enlarging the heat exchange surface of a tubular element guiding a medium and the product obtained thereby.

In known tube heat exchangers, the tubes are held and fixed at both ends in tube plates of a comparatively heavy weight. With low capacities, these heat exchangers yield excellent results, but with higher capacities this known construction is too heavy. Moreover, this construction is not suitable for withstanding heavy stresses due to temperature fluctuations. The invention has for its object to construct a heat exchanger so that even with very high capacities the structure remains light and is flexible to an extent such that it can match stresses in the largest possible temperature range.

The invention provides to this end a heat exchanger in which at least one distribution stage consisting of a plurality of manifolds and/or a collecting stage is arranged between the tube bundle and the distribution header or the collection header respectively so that one medium is stepwise divided uniformly in partial streams and/or these partial streams are uniformly united to a main stream.

In the construction according to the invention, the tube plate is, so to say, divided into separate elements so that thermal stresses can be better absorbed. With this construction particularly tubes widely spaced apart in the bundle and likely to be subjected to a completely different thermal load can match their individual conditions independently of one another.

The invention proposes furthermore to construct each of the elements forming a distribution or collection manifold in the form of a box which is fastened to the header by that side which is joined by the tubes. In this embodiment, the dividing elements may be considered to be fastened on one side so that they can elastically bend outwardly when the tubes secured thereto become shorter or longer due to temperature changes.

In a particular embodiment, the distribution manifolds are connected side by side to the longitudinal sides of elongated headers. In this way, a kind of fish-bone pattern is formed while the heat exchanger in this construction has a very compact shape.

If the exchanger has to be employed as a contact stream exchanger, that is to say, that the other medium is guided in the direction of the length of the tubes, the invention proposes to render the distance between the box-shaped distribution manifolds at least equal to the width thereof. In this way, the other medium can be brought, past between the distribution manifolds, into contact with the tube bundle and be conducted away past between the opposite manifolds.

The capacity of a heat exchanger according to the invention may be further enhanced by providing a second distribution or collection stage so that more tubes can be connected with a connecting opening of the manifolds of the first stage. In order to obtain a compact structure the invention proposes to construct the elements of the second stage in cylindrical shapes, the sheath surface thereof having connecting openings for holding a tube each. In this way, the tubes are disposed in a circular array in groups.

In order to enlarge the heat exchanging surface of the tubes, their outer surfaces may be provided with vanes or a folded tape fastened thereto. Also, it may be advantageous to arrange displacer bodies in the remaining space between the tubes and the surface enlarging members so that the other medium is compelled to flow most closely along the tubes.

If the heat exchanger has to perform heat transfer between media of a high difference in volumes passing through per unit time, which may be the case with regenerators for combustion engines, in which one medium is formed by compressed air for the combustion and the other medium is formed by the exhaust gases of the engine, the invention proposes to arrange a coaxial inner pipe within a tube. Thus, one medium is passed through the annular shape between the pipe and the tube while the other medium flows both around the outer tube and through the inner pipe.

Further the invention has for its object to facilitate the enlargement of the heat exchange surface of a tubular element and proposes to fasten a rim of at least a first length of flexible material to the surface of the element, to subsequently wind the material in a stretched state around the element while simultaneously a second length of material previously shaped in a recessed or corrugated shape is clamped tight between the element and the first length of material, the latter being secured at a given distance from its fastened rim to the element itself.

The advantage of the method of the invention resides in that the notched or corrugated length of material, when arranged around the tubular element, is not loaded in the plane of the material, but is only loaded in a direction at right angles thereto owing to the clamping effect between the first length of material and the tubular element. As a result, the corrugated or notched shape of the second length of material is not varied substantially while a satisfactory contact pressure between the material and the tubular element nevertheless is ensured. Thus, the desired size of the heat exchange surface can be maintained in a simple manner.

In order to improve the heat conduction across the contact surfaces between the second length of material and the tubular element, the surface of the latter may previously be covered with a fastening means such as copper foil or soldering paste which is heated, subsequent to winding, at a suitable fusing temperature.

The dimensions of the two lengths of material may be arbitrary. A length of material may be considered as the dimension which, in an axial direction, is equal to the length of the tubular element. Therefore, if the tubular element has to be provided all around with an enlarged heat exchange surface, a length of material need be provided enabling one revolution around the tubular element. Alternatively, strips of material may be employed which are helically wound around the tubular element.

The connection of the first length of material with the tubular element, or with itself, is preferably established by means of spot welding. The first length of material may be held in a stretched state in many ways, but it is preferred to guide this length of material across resistance means so that during the winding operation a resistive force is exerted on the first length of material to hold it in a stretched state. A particularly effective embodiment is that in which the pipe is turned in a support about its own axis.

The invention furthermore relates to the product obtained by said method which permits the heat exchange surface to assume many shapes. A flexible sheet may be considered to form the second length of material which is locally recessed on one side or on both sides. The second length of material may, as an alternative, be formed by a strip of material previously bent or folded in zigzag fashion, with the dimension in the axial direction being smaller than the length of the tubular element. This strip is helically wound around the tubular element so that the whole length thereof may be covered.

The invention proposes to arrange the folds of the strip at an angle complementary to the helical angle with respect to the side edges of the strip. This has the advantage that after the strip has been wound around the tubular element, the fold edges are accurately disposed axially to ensure a particularly satisfactory conduction through the wall and the strip shaped material.

Further features of the invention relating to the heat exchanger and the tubular element for a heat exchanger will become apparent from the following description of a preferred embodiment of the invention.

In the drawing:

FIG. 2 is a perspective view of the heat exchanger of FIG. 1;

FIG. 5 is an axial sectional view of a detail of FIG. 3, indicating the mode of connection of the end of the tube element of FIG. 3 to an element of a second distribution or collection stage;

FIG. 6 is an arbitrary cross sectional view of a group of tube elements fastened to an element of FIG. 5;

Figure 1:
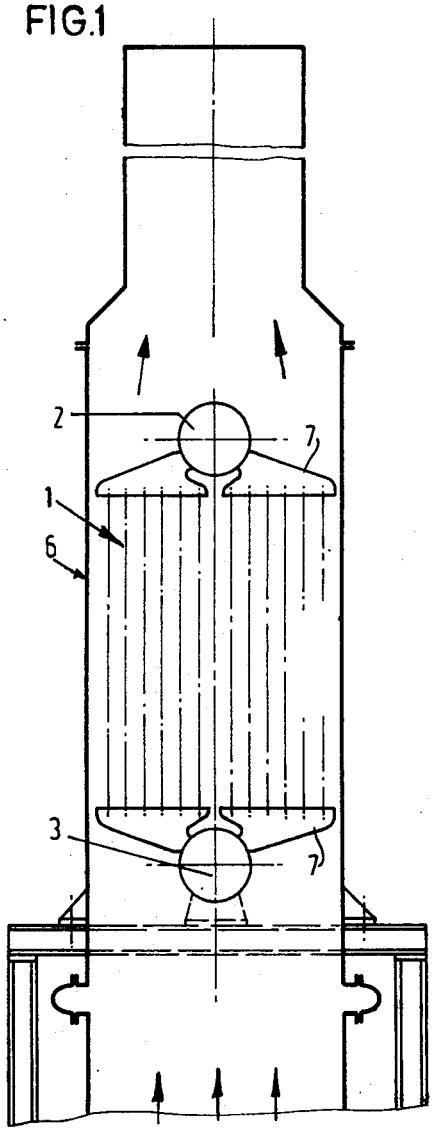
FIG. 1 is a schematic illustration of a contact-flow heat exchanger in accordance with the invention.

The embodiment of a heat exchanger in accordance with the invention to be described hereinafter comprises generally a tube bundle 1 connected on the top and bottom sides with a distribution header 2 and a collection header 3, respectively. The pipe tube bundle guides one medium from the connecting flange 4 of the distribution header 2 towards the connecting flange 5 of collection header 3. The other medium is guided along the tube bundle 1 by a surrounding envelope 6. The other medium flows in upward direction, viewed in FIG. 1, so that heat exchange takes place in counterflow of the two media.

The most important feature of the invention is that one medium is divided stepwise from distribution header 2 into smaller partial streams before it reaches tube bundle 1. On the other hand, these partial streams are stepwise united to a main stream into collection header 3. This division and integration is performed in a first stage by the manifold 7 connected with headers 2 and 3. In order to divide the partial stream again in element 7, the joining elements of the second stage 8 are provided, and these are finally connected with a plurality of tubes in bundle 1. In the embodiment shown, two stages are thus formed, but, if desired, more than two stages may be provided.

Figure 3:
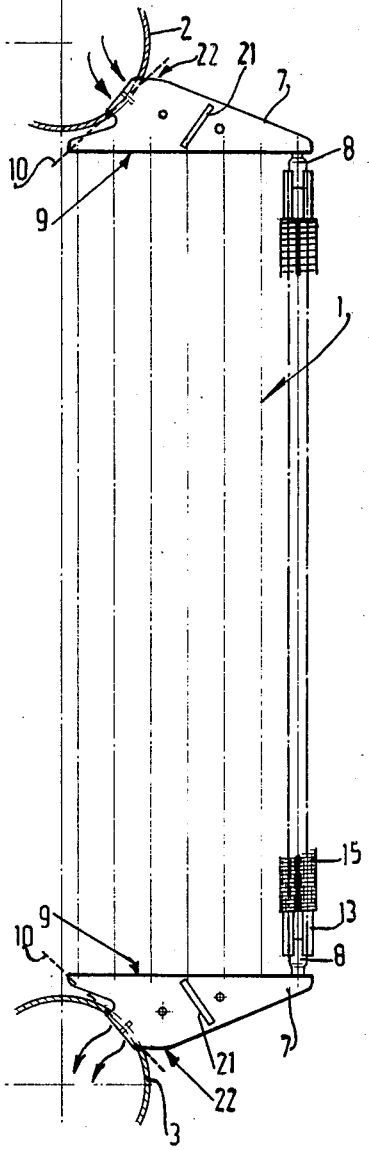
FIG. 3 is a schematic front view of a part of the tube bundle of FIG. 2.

Each element 7 has the shape of a flat box, one side 9 of which is connected via elements 8 with the tubes in bundle 1, whereas the side 10 joining the former side 9, and indicated by the broken line in FIG. 3, is connected with distribution header 2 or collecting header 3. This construction provides a particularly elastic fastening of the pipes to the headers 2 and 3.

FIG. 2 shows in particular that the most compact structure is obtained by means of a fish-bone array of manifolds 7 with respect to the headers 2 and 3 and, since a contact stream heat exchanger is being considered here, the space between manifolds 7 will exceed the width of the elements in order to ensure a minimum resistance.

The cylindrical elements 8 of the second distribution stage have apertures in their sheaths. See FIG. 5. These apertures 11 are individually joined by a tube of bundle 1 and, if the apertures are uniformly arranged along the circumference of element 8, a tube array as shown in FIG. 6 can be obtained. FIG. 6 shows four tubes, but it is obvious that a larger or smaller number may be used.

In the heat exchanger shown, constructed as a regenerator, the tubes in bundle 1 are shaped so that the volume of one medium matches that of the other medium to the optimum. For this purpose, the tube comprises an outer pipe 12 an inner pipe 13 (see FIGS. 4, 5, and 6). One medium passes through the annular space between the two pipes 12 and 13, and the other medium flows along the outer side of pipe 12 and through the interior of pipe 13. The two pipes, 12 and 13, are interconnected at their ends so that at the ends the annular space between the two pipes is completely closed with the exception of passages 14 in the wall of pipe 12. These apertures 14 communicate with the passages 11 of the cylindrical element 8. This disposition and connection of pipes 12 and 13 with elements 8 ensure a particularly satisfactory conveyance of the other medium through inner pipe 13.

Figure 4:
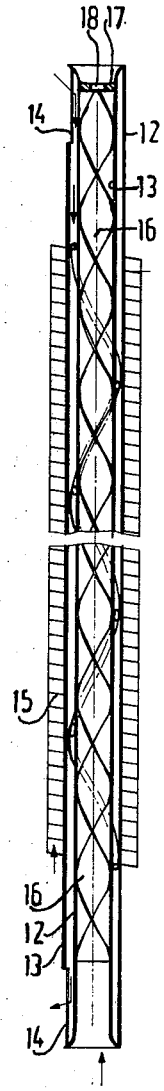
FIG. 4 is an axial sectional view of a tube element suitable for use in a heat exchanger employed as a regenerator.

The heat exchanging surface of outer pipe 12 may be enlarged by fastening members to the outer surface thereof in the form of vanes or a folded tape helically wound around pipe 12. A member of this structure may also be arranged in the inner pipe 13, but a particularly simple embodiment is shown in FIG. 4 as a helically torsioned plate 16. The pitch of the helix can be adapted to the properties of the other medium in order to obtain an optimum heat transfer. The flow rate through the inner pipe 13 can be controlled by means of a transverse partition 17 which is preferably disposed at the end of pipe 13 and is provided with an uninterrupted hole 18, the diameter of which determines the passing quantity.

The annular space between the two pipes 12 and 13 may also accomodate a helical partition, the pitch and direction of which can be adapted to the properties of the one medium.

In the spaces between the tubes of bundle 1, displacer bodies 19 may be arranged loosely between the cylindrical elements. The bodies 19 ensure a most intimate flow of the other medium along pipe 12.

In order to obtain an optimum conveyance of the stream at the transition between the annular space between pipes 12 and 13 and the cylindrical element 8, the side 20 of element 8 remote from element 7 is depressed as shown in FIG. 5.

The space between the elements 7 of the first distribution or collection stage may be provided with vanes 21 for guiding the other medium through the tube bundle 1. The vanes are preferably fastened at an angle to the sidewalls of manifolds 7.

An advantage in mounting is obtained by holding the distal sides 22 of opposite manifolds 7 in relatively parallel positions. The unit formed by the manifold 7 and the tube bundle 1 can thus be slipped, without wriggling, into the previously set headers 2 and 3 and welded in place.

Figure 7:
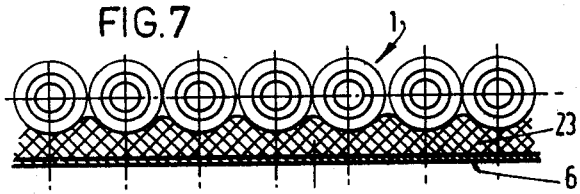
FIG. 7 is a cross sectional view of part of the outer tubes of the bundle and the envelope of the heat exchanger of FIG. 1.

The construction of the heat exchanger in accordance with the invention is particularly suitable for a separate support of the tube bundle with its inlet and outlet headers 2 and 3, and the envelope 6. See FIG. 1. Therefore, the envelope 6 may have a comparatively light weight since, in fact, it only serves to guide the other medium. Between envelope 6 and the outer tubes of bundle 1 a deformable or elastic layer 23 may be provided (FIG. 7) which, on one hand, isolates the heat of the other medium from the wal of envelope 6 and, on the other hand, ensures a flow of the other medium as close as possible to the tubes.

Other embodiments are possible within the scope of the invention. The headers 2 and 3, for example, need not be elongated and tubular. They may have any suitable shape, such as a cylindrical shape, in which case, the manifolds 7 would be arrayed along their circumference. As a matter of course, when an inner pipe 13 is not provided, the ends of pipe 12 may be bent over at an angle with the head faces directly engaging the sheath and the passage 11 of cylindrical element 8.

Referring to FIGS. 8 to 11, the reference numeral 31 designates a tubular element through which flows a medium to be cooled or heated. The outer surface of pipe 31 is enlarged by a folded, corrugated or bulging sheet or strip 32 which is arranged around the pipe. This arrangement is carried out by a method included in the invention with the aid of an additional length of material 33, one edge or end of which is fastened to the surface of pipe 31 by spot welding. See FIG. 9. The length of material 33 is kept in the stretched state by resistive means while pipe 31 is turned about its center line in a support not shown. Prior to turning the pipe, the folded strip 32 first is arranged between the stretched strip 33 and pipe 31 so that it is clamped tight during rotation. From FIGS. 8 to 11 it will be apparent that, during rotation of pipe 31, the loose end portion of folded strip 32 does not produce any tensile load in the plane of the strip, but that only a pressure force is exerted at right angles to the pipe surface. Since a tensile force is not exerted in the strip 32, the folds thereof are not stretched so that the desired heat exchange surface can be obtained in a simple manner.

Figure 8:
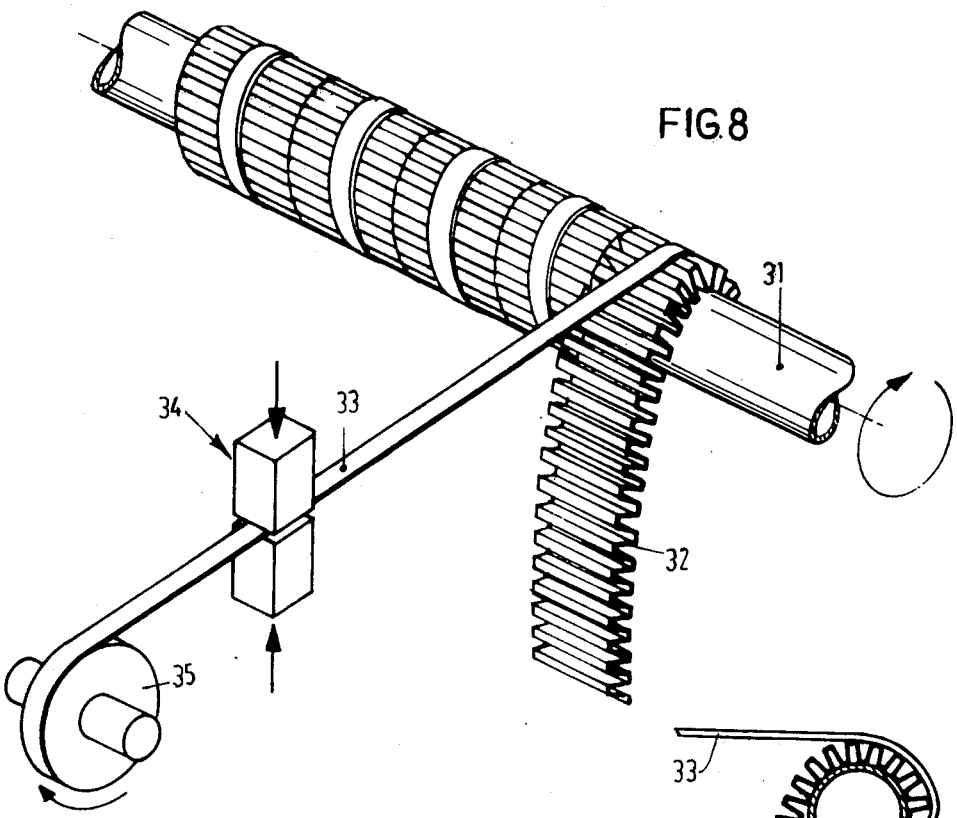
FIG. 8 is a perspective view of a preferred embodiment for enlarging the heat exchange surface of a tube element.

FIG. 8 shows that a strip-shaped folded length of material 32 and a strip-shaped length of material 33 are initially wound off a stock reel 35. Winding is performed in a helical fashion, but it will be apparent that viewed in the axial direction of the pipe the two strips of material may have the same length as the tubular element or pipe 31. In order to accomplish a complete enlargement of the surface of pipe 31, the pipe need only be turned through one revolution.

If the folded strip is helically wound around pipe 31, it is preferred to arrange the folding edges 36 at an angle to the side edges 37 of the strip 32, which angle is complementary to the pitch angle. See FIG. 10. After the folded strip 32 is wound around pipe 31, the contact surface with a width b (see FIG. 10) will extend in an axial direction. This arrangement materially enhances the conductivity between pipe 31 and folded strip 32.

Figure 9:
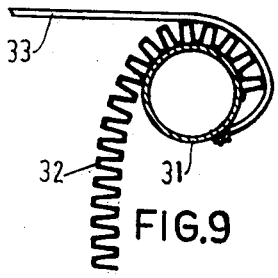
FIG. 9 is an axial elevational view of the tube element of FIG. 8.
Figure 10:
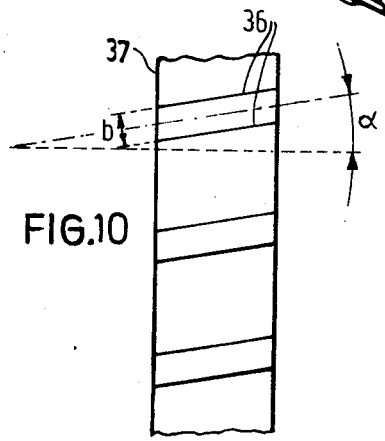
FIG. 10 is a plan view of a folded strip used as shown in FIGS. 8 and 9.
Figure 11:
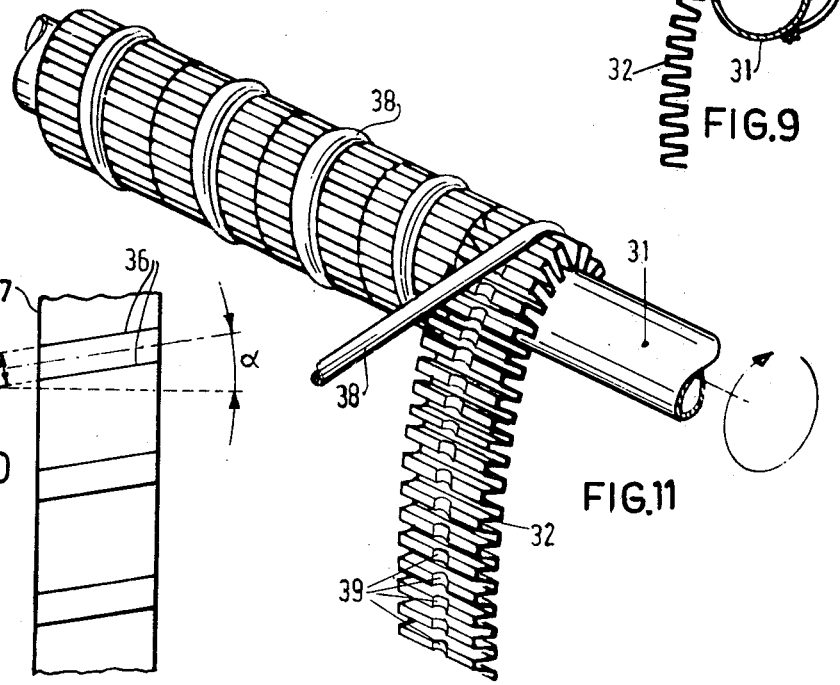
FIG. 11 is an elevational view like FIG. 8 with a wire shaped first length of material.

FIG. 11 shows a wire 38 instead of the flat strip 33. As a further feature, recesses 39 are provided in the peaks of the folded strip 32 to form a guide groove for wire 38. As a matter of course, other guiding means such as projecting cams may be used. In the preferred embodiment of FIGS. 8 to 11 strip 32 is shown folded trapezoidally. Of course, other folding configurations, such as a triangular fold, could be employed. The section of the pipe shown in FIGS. 8 and 9 is round, but may have any other shape desired. Also, it should be noted that the width of strip 33 may be equal to the width of strip 32. Moreover, more than one tensile strip or wire, 32 and 38, may be employed.

Having thus described the invention, it is clear that many different embodiments thereof could be provided without departing from the spirit and scope of the invention, and, therefore, it is intended that the foregoing specification and the drawing be interpreted as illustrative rather than in a limiting sense.

What is claimed is:

1. A heat exchanger comprising an elongated distribution header, an elongated collection header disposed parallel thereto, a plurality of tubes forming a tube bundle, and means for connecting said tube bundle to said headers, said connecting means comprising, a first group of relatively light and flexible elongated box-like distribution manifolds each connected at one end to said distribution header to extend outwardly from said distribution header and arranged in a linear array along one side of said distribution header with one manifold being spaced from an adjacent one by a distance substantially equal to the width of a manifold, a second group of relatively light and flexible elongated box-like distribution manifolds each connected at one end to said distribution header to extend outwardly from said distribution header in a direction opposite to that of said first group of manifolds and arranged in a linear array along another side of said distribution header with one manifold being spaced from an adjacent one by a distance substantially equal to the width of a manifold, each distribution manifold being provided with a plurality of outlet ports disposed linearly along the side of the manifold adjacent to the end connected to the distribution header, a first group of relatively light and flexible elongated box-like collection manifolds each connected at one end to said collection header to extend outwardly from said collection header and arranged in a linear array along one side of said collection header with one manifold being spaced from an adjacent one by a distance substantially equal to the width of a manifold, a second group of relatively light and flexible elongated box-like collection manifolds each connected at one end to said collection header to extend outwardly from said collection header in a direction opposite to that of said first group of manifolds and arranged in a linear array along another side of said collection header with one manifold being spaced from an adjacent one by a distance substantially equal to the width of a manifold, each collection manifold being spaced from and disposed opposite an associated distribution manifold and provided with a plurality of inlet ports disposed linearly along the side of the manifold adjacent to the end connected to the collection header and in alignment with the outlet ports in the oppositely disposed associated distribution manifold so that tubes of the tube bundle can be connected between each pair of opposite aligned ports of the distribution and collection manifolds, the arrangement being such that each pair of associated manifolds and the tubes connected thereto form a panel-like heat exchange unit containing only a small number of the tubes in the tube bundle and wherein the manifolds can flex when the tubes connected thereto expand or contract depending on the thermal conditions in that part of the heat exchanger, and an envelope surrounding the aforesaid elements of the heat exchanger for guiding a fluid medium around the tube bundle.

2. A heat exchanger according to claim 1 including distribution connecting means for connecting tubes of the tube bundle to a distribution manifold having an inlet port connected to an outlet port of the distribution manifold and a pluality of outlet ports to each of which a tube is connected, and a collection connecting means for connecting tubes of the tube bundle to a collection manifold having a plurality of inlet ports each connected to a tube and an outlet port connected to an inlet port of the collection manifold.

3. A heat exchanger according to claim 2 wherein each distribution connecting means comprises a cylindrically shaped member having one end thereof connected to an outlet port of said distribution manifold and each collection connecting means comprise a cylindrically shaped member having one end thereof connected to an inlet port of said collection manifold, and each distribution and each collection connecting means is provided with a plurality of circumferential ports to which the tubes are connected.

4. A heat exchanger according to claim 3 wherein each distribution connecting means and each collection connecting means is provided with an inwardly disposed spherical end member opposite its inlet/outlet end, respectively.

5. A heat exchanger according to claim 3 wherein each tube of the tube bundle includes means integral with the outside surface of the tube for increasing the heat transfer capacity of the tube.

6. A heat exchanger according to claim 3 wherein each tube of the tube bundle comprises an inner and an outer pipe having a fluid conducting space therebetween which space is closed at both its ends, said pipes having an inlet port for connecting said fluid conducting space to a port of said distribution connecting means and an outlet port for connecting said fluid conducting space to a port of said collection connecting means.

7. A heat exchanger according to claim 6 including an apertured plate provided at the ends of the inner pipe so as to control the flow of a fluid through said inner pipe.

8. A heat exchanger according to claim 6 including a baffle member provided in the space between the inner and the outer pipes.

9. A heat exchanger according to claim 7 including a baffle member provided within said inner pipe.

10. A heat exchanger according to claim 1 including a plurality of baffle members provided between the tubes of the tube bundle for guiding a fluid into contact with the outer surface of the tubes.

11. A heat exchanger according to claim 1 including support means for said envelope, and separate support means for said distribution and collection headers, said distribution and collection manifolds, and said tube bundle.

* * * * *